US011988055B2

(12) United States Patent
Li et al.

(10) Patent No.: US 11,988,055 B2
(45) Date of Patent: May 21, 2024

(54) CONTROLLABLE DOWNHOLE DRILLING AND COMPLETION TOOL SEPARATING DEVICE AND THEIR METHOD OF USE

(71) Applicant: Southwest Petroleum University, Chengdu (CN)

(72) Inventors: Gao Li, Chengdu (CN); Pan Fang, Chengdu (CN); Dong Xiao, Chengdu (CN); Hongtao Li, Chengdu (CN); Xu Yang, Chengdu (CN); Yongjie Li, Chengdu (CN); Yangyang Xu, Chengdu (CN); Guo Liu, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 18/092,770

(22) Filed: Jan. 3, 2023

(65) Prior Publication Data

US 2023/0392464 A1 Dec. 7, 2023

(30) Foreign Application Priority Data

Jun. 7, 2022 (CN) ..... 202210636386.X

(51) Int. Cl.
*E21B 23/06* (2006.01)
*E21B 31/12* (2006.01)

(52) U.S. Cl.
CPC ..... *E21B 23/06* (2013.01); *E21B 31/12* (2013.01)

(58) Field of Classification Search
CPC ..... E21B 23/06; E21B 23/0143; E21B 31/12; E21B 17/06; E21B 17/046; E21B 33/12
See application file for complete search history.

(56) References Cited

U.S. PATENT DOCUMENTS 5,787,982 A * 8/1998 Bakke ..... E21B 17/06 166/242.6
6,923,256 B2 * 8/2005 Parker ..... E21B 17/06 166/242.7

(Continued)

FOREIGN PATENT DOCUMENTS

CN 113250647 B 9/2021
CN 111119771 B 3/2022
CN 113153192 B 3/2022

*Primary Examiner* — Nicole Coy
*Assistant Examiner* — Nicholas D Wlodarski
(74) *Attorney, Agent, or Firm* — MUNCY, GEISSLER, OLDS & LOWE, P.C.

(57) ABSTRACT

A controllable downhole drilling and completion tool separating device and their method of use are provided. The device includes an upper mandrel connector, an outer sleeve, a claw clamp sleeve, a claw clamp locking ring, a mandrel sleeve, a lower connector, a piston ring and a pressure bearing ball. The upper end of the lower connector is on the outer side of the upper connector in a sleeving mode. A first annular cavity is between the lower connector and the upper connector. The piston ring is on the outer side of the upper connector in a sleeving mode and located in the first annular cavity. The claw clamp sleeve and the outer sleeve are sequentially arranged on the outer side of the upper connector in a sleeving mode. A second annular cavity is communicated with the first annular cavity and formed between the claw clamp sleeve and the upper connector.

7 Claims, 4 Drawing Sheets

(56) References Cited

U.S. PATENT DOCUMENTS

| | | | | |
|---|---|---|---|---|
| 8,464,788 | B2 * | 6/2013 | Stanford | E21B 17/06<br>166/242.6 |
| 2014/0352975 | A1 * | 12/2014 | Rogers | E21B 43/10<br>166/242.6 |

* cited by examiner

CONTROLLABLE DOWNHOLE DRILLING AND COMPLETION TOOL SEPARATING DEVICE AND THEIR METHOD OF USE

TECHNICAL FIELD

The present invention relates to the field of oil and natural gas drilling tools, in particular to a controllable downhole drilling and completion tool separating device and their method of use.

BACKGROUND ART

Separating devices such as a safe releasing mechanism are widely applied in various working conditions such as jamming release, drilling tool separation, and packer separation in the field of drilling and completion. With the development of the integration of drilling and completion, new requirements are put forward for downhole separating devices. On the one hand, the downhole separating devices need to transmit torque during the drilling process, and on the other hand, need to achieve safe and reliable separation under various working conditions. The separating devices are implemented as mechanical separating devices and hydraulic separating devices. The existing mechanical releasing devices are mostly of a ground throwing rod impacting type and a rotating pipe string releasing type; and the hydraulic releasing devices are mostly implemented to shear off pins by pitching and pressing.

A general downhole separating device structure needs to be studied.

In the Chinese patent having application number "202110042639.6" and entitled "Hydraulic Gripper Tool for Preventing Jamming and Blockage", the tool can be directly lifted up by using a hydraulic gripper structure in the case of jamming, and a shear load of the releasing mechanism can be adjusted by the number of pins. However, this structure does not fully consider the torque transmission during drilling and does not involve multiple operating conditions, so its application has certain limitations.

In the Chinese patent having application number "201811293585.5" and entitled "Releasing Device and Drilling Pipe String Including the Same", the releasing device can transmit a large torque by means of a toothing assembly when mounted on a drill pipe.

However, this structure does not consider the situation where releasing cannot be performed by pitching and pressing during gas drilling or the pressure is not enough to shear off the pins. In the Chinese patent having application number "202110810796.7" and entitled "Suspension and Completion Integrated Packer and Completion Pipe String", a structure of a releasing augmentor is proposed to realize the release in both mechanical and hydraulic ways. However, this structure also does not consider the working conditions of torque transmission and gas drilling.

The applicants have found that the prior art at least has the following technical problems:

- a downhole separating device in the prior art cannot meet at the same time: the adaption to a variety of working conditions and common use in torque transmission and gas-liquid medium drilling, and thus has great limitations in application.

SUMMARY OF THE INVENTION

An object of the present invention is to provide a controllable downhole drilling and completion tool separating device and their method of use, so as to solve the technical problem that a downhole separating device in the prior art cannot meet at the same time: the adaption to a variety of working conditions and common use in torque transmission and gas-liquid medium drilling, and thus has great limitations in application.

To achieve the above object, the present invention adopts the following technical solution:

The present invention provides a controllable downhole drilling and completion tool separating device, comprising an upper mandrel connector, an outer sleeve, a claw clamp sleeve, a claw clamp locking ring, a mandrel sleeve, a lower connector, a piston ring and a pressure bearing ball, wherein

- the upper end of the lower connector is arranged on the outer side of the upper mandrel connector in a sleeving mode, and a first annular cavity is formed between the lower connector and the upper mandrel connector; the piston ring is arranged on the outer side of the upper mandrel connector in a sleeving mode and located in the first annular cavity;
- the claw clamp sleeve and the outer sleeve are sequentially arranged on the outer side of the upper mandrel connector in a sleeving mode, and a second annular cavity is formed between the claw clamp sleeve and the upper mandrel connector; the first annular cavity is communicated with the second annular cavity; the claw clamp locking ring is arranged on the outer side of the upper mandrel connector in a sleeving mode, and located in the second annular cavity; the claw clamp locking ring is connected to the upper mandrel connector through a pin;
- the mandrel sleeve is arranged on the outer side of the upper mandrel connector in a sleeving mode, and located between the claw clamp locking ring and the piston ring;
- a size of the pressure bearing ball is adaptive with an inner diameter of the lower connector;
- the outer sleeve is arranged on the outer side of the lower connector in a sleeving manner; and
- the upper mandrel connector is provided with a through hole therein, wherein the through hole is provided with a bypass hole at a position corresponding to the first annular cavity, and the bypass hole corresponds positionally to the piston ring.

Optionally or preferably, the outer surface of the lower end of the upper mandrel connector is circumferentially connected with the lower connector through a spline.

Optionally or preferably, a sealing ring is arranged at the contact between the piston ring and the upper mandrel connector and the contact between the piston ring and the lower connector, respectively.

Optionally or preferably, the piston ring is provided with sealing ring mounting grooves which are respectively formed in the corresponding side that contacts the upper mandrel connector and the lower connector.

Optionally or preferably, the claw clamp sleeve is in threaded connection to the outer side of the upper mandrel connector; mounting steps are arranged at one end of the upper mandrel connector away from the lower connector; an outer thread is arranged at a position, close to the mounting steps, on the outer side of the upper mandrel connector; and an inner thread that is matched with the outer thread is arranged at a corresponding position of the claw clamp sleeve.

Optionally or preferably, the first annular cavity and the second annular cavity have the same size.

Optionally or preferably, the outer sleeve is in threaded connection to the lower connector; an outer thread is arranged at the upper part of the lower connector; and an inner thread that is matched with the outer thread is arranged at a corresponding position of the outer sleeve.

The present invention provides a using method for the controllable downhole drilling and completion tool separating device, the using method comprises: in the case of suddenly jammed drilling during the drilling process, separating an upper drilling tool from a lower fish by using the controllable downhole drilling and completion tool separating device if a conventional jamming releasing method is invalid; and the using method further comprises: performing drill pipe pre-completion by using the controllable downhole drilling and completion tool separating device.

Further, in the case of suddenly jammed drilling during the drilling process, the separating the upper drilling tool from the lower fish by using the controllable downhole drilling and completion tool separating device, if the conventional jamming releasing method is invalid specifically comprises:

putting the pressure bearing ball into a drilling medium if the drilling medium is liquid, inputting a pressure to a hollow part of a pipe string by using a sludge pump or a gas pump at the upper wellhead to drive the claw clamp locking ring to move upward, and unlocking the claw clamp sleeve to realize the separation of the upper mandrel connector from the lower connector; and putting the pressure bearing ball into a drilling medium if the drilling medium is a gas, filling liquid into the hollow part of the pipe string, inputting a pressure to a hollow part of the pipe string to drive the claw clamp locking ring to move upward, and unlocking the claw clamp sleeve to realize the separation of the upper mandrel connector from the lower connector.

Further, the performing drill pipe pre-completion by using the controllable downhole drilling and completion tool separating device, specifically comprises the following steps:

S1: normally drilling to a target production layer and entering a completion process;

S2: setting a drill pipe suspension packer to pack the production layer;

S3: putting the pressure bearing ball into a drilling medium if the drilling medium is liquid, inputting a pressure to a hollow part of a pipe string by using a sludge pump or a gas pump at the upper wellhead to drive the claw clamp locking ring to move upward, and unlocking the claw clamp sleeve to realize the separation of the upper mandrel connector from the lower connector;

S4: putting the pressure bearing ball into a drilling medium if the drilling medium is a gas, filling liquid to the hollow part of the pipe string, inputting a pressure to the hollow part of the pipe string to drive the claw clamp locking ring to move upward, and unlocking the claw clamp sleeve to realize the separation of the upper mandrel connector from the lower connector;

S5: lifting an upper drill pipe drilling tool; and

S6: lowering an oil tube and its tool set to be connected back to the controllable downhole drilling and completion tool separating device.

The embodiments of the present invention at least can produce the following technical effects:

(1) the controllable downhole drilling and completion tool separating device and their method of use provided by the present invention are more reliable than a hydraulic pin shearing mode commonly used in the art due to the adoption of a hydraulic piston ring structure, and in the case that a downhole separating device is not required to operate, avoid the faults such as advanced separation, thereby improving the reliability;

(2) the controllable downhole drilling and completion tool separating device and their method of use provided by the present invention are applicable to a drilling and completion integrated process, wherein the upper mandrel connector and the lower connector which are in an unseparated state are circumferentially connected through a spline to transmit the torque required for normal drilling. The cooperation of the downhole separating device and completion tools such as packers can realize drill-pipe pre-completion, reduce the number of trips of lifting and releasing the pipe string, and realize the effective connection between the drilling process and the completion process;

(3) according to the controllable downhole drilling and completion tool separating device and their method of use provided by the present invention, an unlocking method is adopted, which is also applicable to the working conditions of gas drilling; and the liquid column weight and the gas pressure generated by filling the liquid into the pipe string jointly unlock a claw clamp to realize the separation of the underground separating device;

(4) according to the controllable downhole drilling and completion tool separating device and their method of use provided by the present invention, the downhole separating device can be adopted to realize drilling tool separation in the case of suddenly encountering complex downhole conditions, such as jamming if the conventional methods are unavailable to release the jamming; subsequent salvage, casing milling, sidetrack drilling and other operations are then performed; and sundry drill string inverting operation can be avoided, such that the processing time and labor cost of downhole accidents are reduced; and (5) the controllable downhole drilling and completion tool separating device and their method of use provided by the present invention can be widely applied, i.e., can be applied to gas under-pressure drilling and completion and can also be applied to liquid under-balance drilling and completion, and are suitable for drilling and completion of various well tracks, such as straight wells, inclined shafts and horizontal wells.

In drawings, reference symbols represent the following components: 1—upper mandrel connector; 101—bypass hole; 102—variable cross-section segment; 2—outer sleeve; 3—claw clamp sleeve; 4—claw clamp locking ring;

5—mandrel sleeve; 6—lower connector; 7—piston ring; 8—pressure bearing ball; 9—spline; 10—sealing ring; 11—pin.

DETAILED DESCRIPTIONS OF THE PREFERRED EMBODIMENTS

Figure 1:
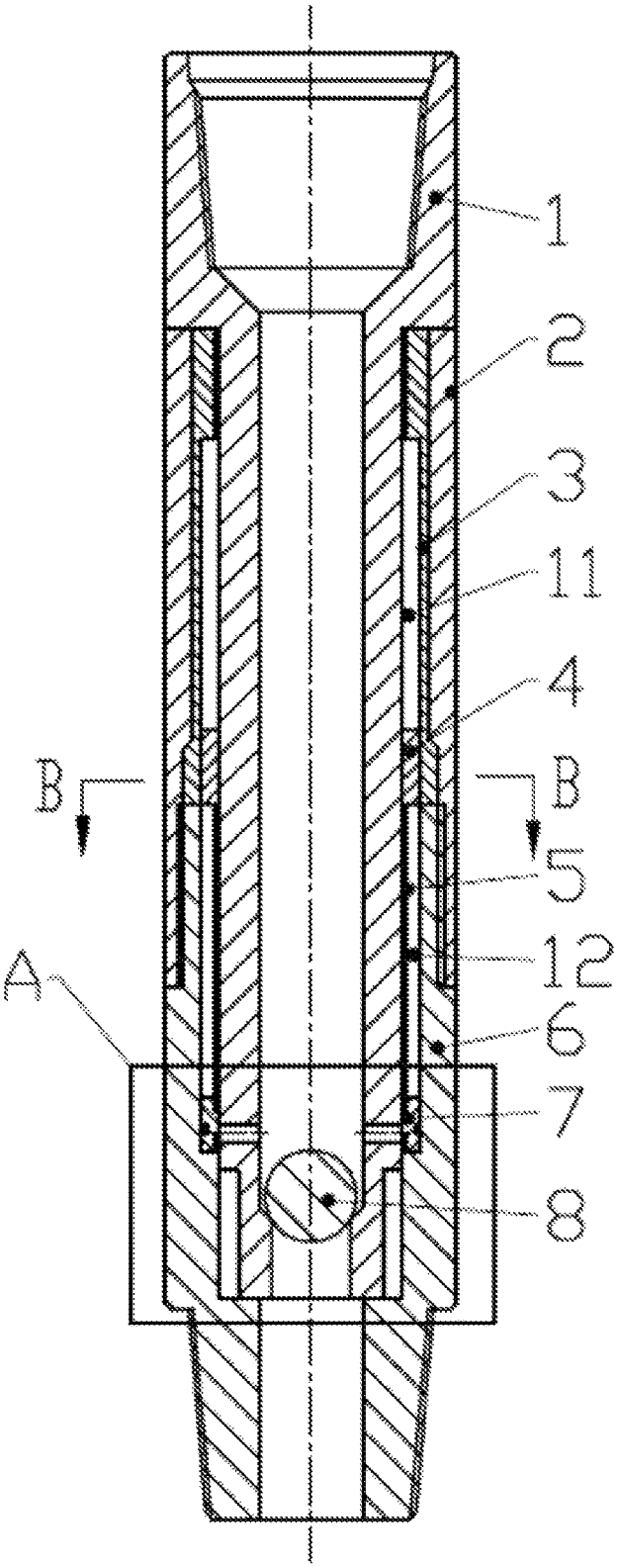
FIG. 1 is a schematic sectional view in which a claw clamp sleeve is in an initial state in Embodiment 1 of the present invention.
Figure 2:
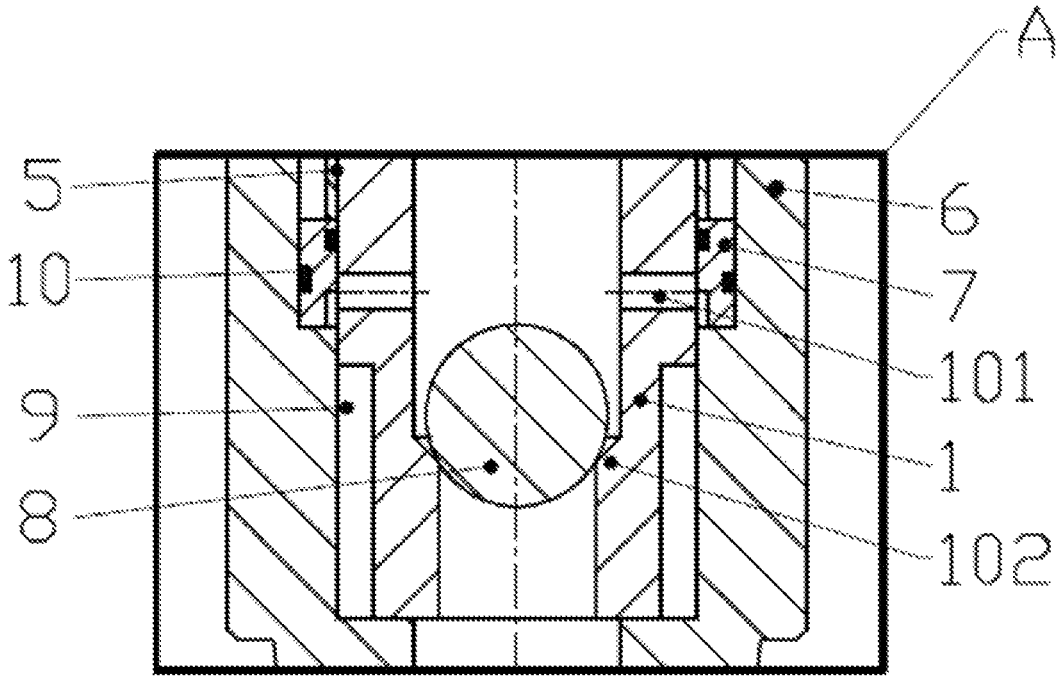
FIG. 2 is an enlarged view of a local structure of Part A in FIG. 1.
Figure 3:
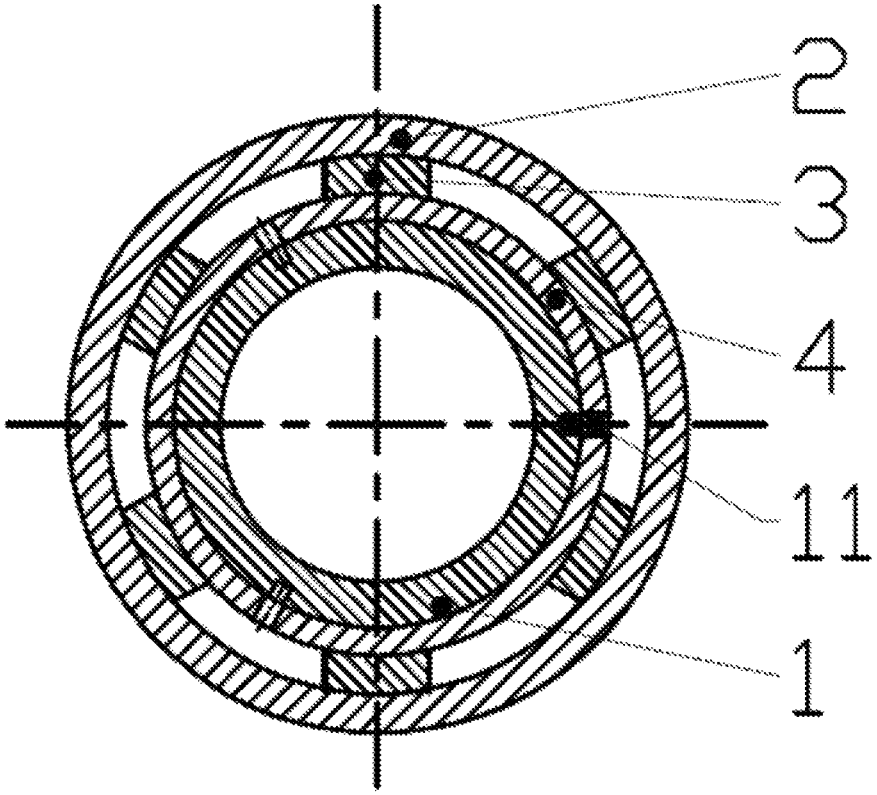
FIG. 3 is a sectional view taken along B-B in FIG. 1.
Figure 4:
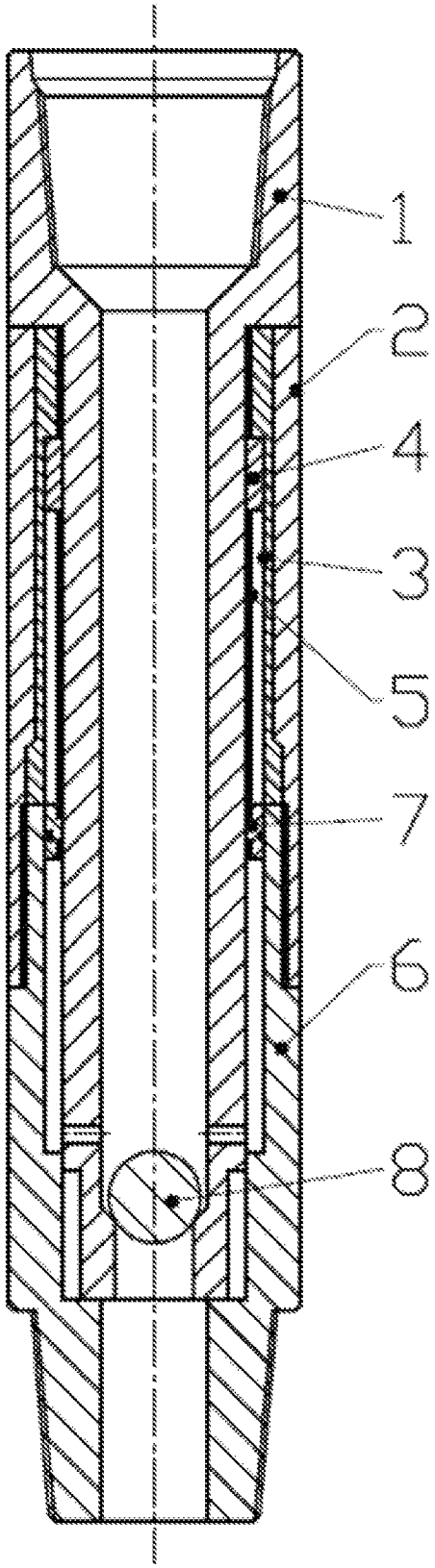
FIG. 4 is a schematic sectional view in which a claw clamp is in an unlocked state in Embodiment 1 of the present invention.
Figure 5:
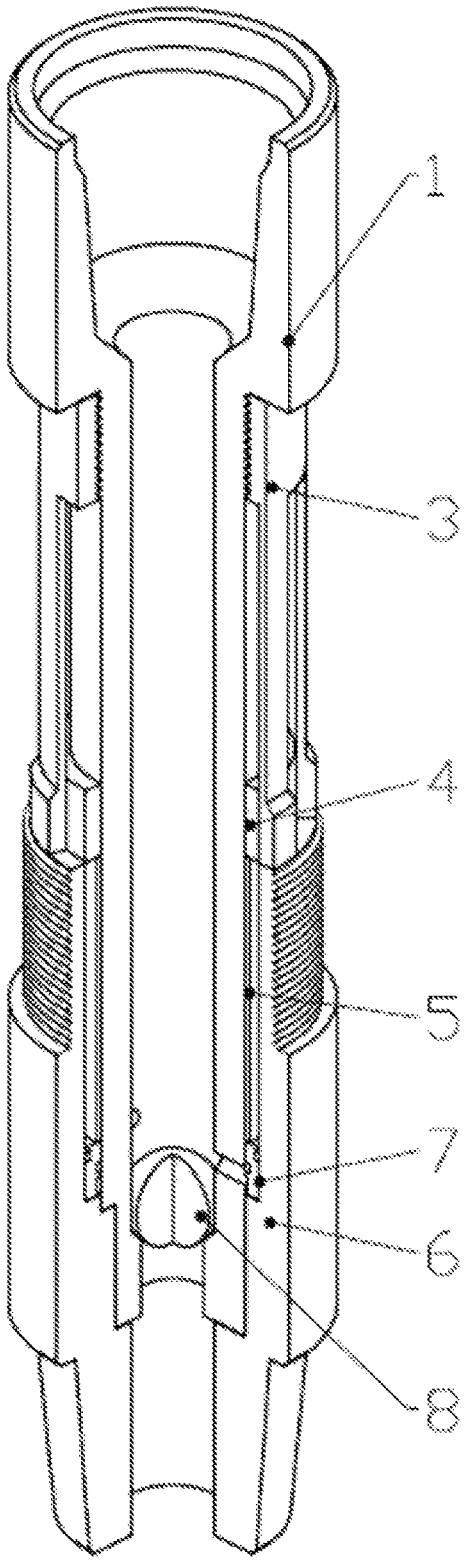
FIG. 5 is a schematic diagram of an internal structure in Embodiment 1 of the present invention.

The details are shown in FIG. 1 to FIG. 5.

Embodiment 1

The present invention provides a controllable downhole drilling and completion tool separating device, which includes an upper mandrel connector 1, an outer sleeve 2, a claw clamp sleeve 3, a claw clamp locking ring 4, a mandrel sleeve 5, a lower connector 6, a piston ring 7 and a pressure bearing ball 8, wherein

- the upper end of the lower connector 6 is arranged on the outer side of the upper mandrel connector 1 in a sleeving mode, and a first annular cavity is formed between the lower connector 6 and the upper mandrel connector 1; the piston ring 7 is arranged on the outer side of the upper mandrel connector 1 in a sleeving mode and located in the first annular cavity;
- the claw clamp sleeve 3 and the outer sleeve 2 are sequentially arranged on the outer side of the upper mandrel connector 1 in a sleeving mode, and a second annular cavity is formed between the claw clamp sleeve 3 and the upper mandrel connector 1; the first annular cavity is communicated with the second annular cavity; the claw clamp locking ring 4 is arranged on the outer side of the upper mandrel connector 1 in a sleeving mode, and located in the second annular cavity; the claw clamp locking ring 4 is connected to the upper mandrel connector 1 through a pin 11;
- the mandrel sleeve 5 is arranged on the outer side of the upper mandrel connector 1 in a sleeving mode, and located between the claw clamp locking ring 4 and the piston ring 7;
- a size of the pressure bearing ball 8 is adaptive with an inner diameter of the lower connector 6;
- the outer sleeve 2 is arranged on the outer side of the lower connector 6 in a sleeving manner; and
- the upper mandrel connector 1 is provided with a through hole therein, wherein the through hole is provided with a bypass hole 101 at a position corresponding to the first annular cavity, and the bypass hole 101 corresponds positionally to the piston ring 7.

As an optional implementation, the outer surface of the lower end of the upper mandrel connector 1 is circumferentially connected with the lower connector 6 through a spline 9.

The controllable downhole drilling and completion tool separating device and their method of use provided by the present invention are more reliable than a hydraulic pin 1 shearing mode commonly used in the art due to the adoption of a hydraulic piston ring 7 structure, and in the case that a downhole separating device is not required to operate, avoid the faults such as advanced separation, thereby improving the reliability; the controllable downhole drilling and completion tool separating device and their method of use provided by the present invention are applicable to a drilling and completion integrated process, wherein the upper mandrel connector 1 and the lower connector 6 which are in an unseparated state are circumferentially connected through the spline 9 to transmit the torque required for normal drilling. The cooperation of the downhole separating device and completion tools such as packers can realize drill pipe pre-completion, reduce the number of trips of lifting and releasing the pipe string, and realize the effective connection between the drilling process and the completion process; according to the controllable downhole drilling and completion tool separating device and their method of use provided by the present invention, an unlocking method is adopted, which is also applicable to the working conditions of gas drilling, and the liquid column weight and the gas pressure generated by filling the liquid into the pipe string jointly unlock a claw clamp to realize the separation of the underground separating device; according to the controllable downhole drilling and completion tool separating device and their method of use provided by the present invention, the downhole separating device can be adopted to realize drilling tool separation in the case of suddenly encountering complex downhole conditions, such as jamming if the conventional methods are unavailable to release the jamming, subsequent salvage, casing milling, sidetrack drilling and other operations are then performed, and sundry drill string inverting operation can be avoided, such that the processing time and labor cost of downhole accidents are reduced; and the controllable downhole drilling and completion tool separating device and their method of use provided by the present invention can be widely applied, i.e., can be applied to gas under-pressure drilling and completion and can also be applied to liquid under-balance drilling and completion, and are suitable for drilling and completion of various well tracks, such as straight wells, inclined shafts and horizontal wells.

As an optional implementation, a sealing ring is arranged at the contact between the piston ring 7 and the upper mandrel connector 1 and the contact between the piston ring 7 and the lower connector 6, respectively.

As an optional implementation, the piston ring 7 is provided with sealing ring mounting grooves which are respectively formed in the corresponding side that contacts the upper mandrel connector 1 and the lower connector 6.

As an optional implementation, the claw clamp sleeve 3 is in threaded connection to the outer side of the upper mandrel connector 1; mounting steps are arranged at one end of the upper mandrel connector 1 away from the lower connector 6; an outer thread is arranged at a position, close to the mounting steps, on the outer side of the upper mandrel connector 1; and an inner thread that is matched with the outer thread is arranged at a corresponding position of the claw clamp sleeve 3.

As an optional implementation, the first annular cavity and the second annular cavity have the same size.

As an optional implementation, the outer sleeve 2 is in threaded connection to the lower connector 6; an outer thread is arranged at the upper part of the lower connector 6; and an inner thread that is matched with the outer thread is arranged at a corresponding position of the outer sleeve 2.

Embodiment 2

In the case of suddenly jammed drilling during the drilling process, the separating the upper drilling tool from the lower fish by using the controllable downhole drilling and completion tool separating device according to Embodiment 1 if the conventional jamming releasing method is invalid specifically comprises:

- putting the pressure bearing ball 8 into a drilling medium if the drilling medium is liquid, inputting a pressure to a hollow part of a pipe string by using a sludge pump or a gas pump at the upper wellhead to drive the claw clamp locking ring 4 to move upward, and unlocking the claw clamp sleeve 3 to realize the separation of the upper mandrel connector 1 from the lower connector 6.

Embodiment 3

In the case of suddenly jammed drilling during the drilling process, the separating the upper drilling tool from the lower fish by using the controllable downhole drilling and completion tool separating device according to Embodiment 1 if the conventional jamming releasing method is invalid specifically comprises:

putting the pressure bearing ball 8 into a drilling medium if the drilling medium is a gas, filling liquid into the hollow part of the pipe string, inputting a pressure to a hollow part of the pipe string to drive the claw clamp locking ring 4 to move upward, and unlocking the claw clamp sleeve 3 to realize the separation of the upper mandrel connector 1 from the lower connector 6.

Embodiment 4

The performing drill pipe pre-completion by using the controllable downhole drilling and completion tool separating device according to Embodiment 1 specifically comprises the following steps:

S1: normally drilling to a target production layer and entering a completion process;

S2: setting a drill pipe suspension packer to pack the production layer;

S3: putting the pressure bearing ball 8 into a drilling medium if the drilling medium is liquid, inputting a pressure to a hollow part of a pipe string by using a sludge pump or a gas pump at the upper wellhead to drive the claw clamp locking ring 4 to move upward, and unlocking the claw clamp sleeve 3 to realize the separation of the upper mandrel connector 1 from the lower connector 6;

S4: lifting an upper drill pipe drilling tool; and

S5: lowering an oil tube and its tool set to be connected back to the controllable downhole drilling and completion tool separating device.

Embodiment 5

The performing drill pipe pre-completion by using the controllable downhole drilling and completion tool separating device according to Embodiment 1 specifically comprises the following steps:

S1: normally drilling to a target production layer and entering a completion process;

S2: setting a drill pipe suspension packer to pack the production layer;

S3: putting the pressure bearing ball 8 into a drilling medium if the drilling medium is a gas, filling liquid to the hollow part of the pipe string, inputting a pressure to the hollow part of the pipe string to drive the claw clamp locking ring 4 to move upward, and unlocking the claw clamp sleeve 3 to realize the separation of the upper mandrel connector 1 from the lower connector 6;

S4: lifting an upper drill pipe drilling tool; and

S5: lowering an oil tube and its tool set to be connected back to the controllable downhole drilling and completion tool separating device.

A working principle of the controllable downhole drilling and completion tool separating device in the present invention is as follows:

in the case that the controllable downhole drilling and completion tool separating device needs to be used, the pressure bearing ball 8 is put into the hollow part of the pipe string, and liquid under the increased pressure from the upper part enters the lower part of the piston ring 7 through the bypass hole 101 to push the piston ring 7 to move upward; the piston ring 7 further pushes the claw clamp locking ring 4 to move upward through the mandrel sleeve 5; when the pressure reaches a set value, the pin 11 between the claw clamp locking ring and the upper mandrel connector 1 is sheared off, and the claw clamp locking ring 4 in this case moves up to an extreme position; at this time, the upper pipe string is directly lifted, and the claw clamp sleeve 3 loses the locking from the claw clamp locking ring 4, and shrinks inward during the upward movement, such that the upper mandrel connector 1 is separated from the lower mandrel.

The invention claimed is:

1. A controllable downhole drilling and completion tool separating device, comprising an upper mandrel connector, an outer sleeve, a claw clamp sleeve, a claw clamp locking ring, a mandrel sleeve, a lower connector, a piston ring and a pressure bearing ball, wherein an upper end of the lower connector is arranged on an outer side of the upper mandrel connector in a sleeving mode, and a first annular cavity is formed between the lower connector and the upper mandrel connector; the piston ring is arranged on the outer side of the upper mandrel connector in a sleeving mode and located in the first annular cavity;

the claw clamp sleeve and the outer sleeve are sequentially arranged on the outer side of the upper mandrel connector in a sleeving mode, and a second annular cavity is formed between the claw clamp sleeve and the upper mandrel connector; the first annular cavity is communicated with the second annular cavity; the claw clamp locking ring is arranged on the outer side of the upper mandrel connector in a sleeving mode, and located in the second annular cavity; the claw clamp locking ring is connected to the upper mandrel connector through a pin;

the mandrel sleeve is arranged on the outer side of the upper mandrel connector in a sleeving mode, and located between the claw clamp locking ring and the piston ring;

a size of the pressure bearing ball is adaptive with an inner diameter of the lower connector;

the outer sleeve is arranged on an outer side of the lower connector in a sleeving manner; and the upper mandrel connector is provided with a through hole therein, wherein the through hole is provided with a bypass hole at a position corresponding to the first annular cavity, and the bypass hole corresponds positionally to the piston ring, wherein the first annular cavity and the second annular cavity have a same size.

2. The controllable downhole drilling and completion tool separating device according to claim 1, wherein an outer surface of a lower end of the upper mandrel connector is circumferentially connected with the lower connector through a spline.

3. The controllable downhole drilling and completion tool separating device according to claim 2, wherein a sealing ring is arranged at a contact between the piston ring and the upper mandrel connector and a contact between the piston ring and the lower connector, respectively.

4. The controllable downhole drilling and completion tool separating device according to claim 1, wherein the piston ring is provided with sealing ring mounting grooves which are respectively formed in a corresponding side that contacts the upper mandrel connector and the lower connector.

5. The controllable downhole drilling and completion tool separating device according to claim 1, wherein the outer sleeve is in threaded connection to the lower connector; an outer thread is arranged at the upper part of the lower connector; and an inner thread that is matched with the outer thread is arranged at a corresponding position of the outer sleeve.

6. A using method for the controllable downhole drilling and completion tool separating device according to claim 1, comprising:

in the case of suddenly jammed drilling during the drilling process, separating an upper drilling tool from a lower fish by using the controllable downhole drilling and completion tool separating device; and performing drill pipe pre-completion by using the controllable downhole drilling and completion tool separating device, wherein the performing drill pipe pre-completion by using the controllable downhole drilling and completion tool separating device according to specifically comprises the following steps:

S1: normally drilling to a target production layer and entering a completion process;

S2: setting a drill pipe suspension packer to pack the production layer;

S3: putting the pressure bearing ball into a drilling medium if the drilling medium is liquid, inputting a pressure to a hollow part of a pipe string by using a sludge pump or a gas pump at an upper wellhead to drive the claw clamp locking ring to move upward, and unlocking the claw clamp sleeve to realize a separation of the upper mandrel connector from the lower connector;

S4: putting the pressure bearing ball into a drilling medium if the drilling medium is a gas, filling liquid to the hollow part of the pipe string, inputting a pressure to the hollow part of the pipe string to drive the claw clamp locking ring to move upward, and unlocking the claw clamp sleeve to realize the separation of the upper mandrel connector from the lower connector;

S5: lifting an upper drill pipe drilling tool; and

S6: lowering an oil tube and its tool set to be connected back to the controllable downhole drilling and completion tool separating device.

7. The using method for the controllable downhole drilling and completion tool separating device according to claim 6, wherein, in the case of suddenly jammed drilling during the drilling process, the separating the upper drilling tool from the lower fish by using the controllable downhole drilling and completion tool separating device comprises:

putting the pressure bearing ball into a drilling medium if the drilling medium is liquid, inputting a pressure to a hollow part of a pipe string by using a sludge pump or a gas pump at an upper wellhead to drive the claw clamp locking ring to move upward, and unlocking the claw clamp sleeve to realize a separation of the upper mandrel connector from the lower connector; and putting the pressure bearing ball into a drilling medium if the drilling medium is a gas, filling liquid into the hollow part of the pipe string, inputting a pressure to the hollow part of the pipe string to drive the claw clamp locking ring to move upward, and unlocking the claw clamp sleeve to realize the separation of the upper mandrel connector from the lower connector.

* * * * *